US006736096B2

(12) United States Patent
Pierik

(10) Patent No.: US 6,736,096 B2
(45) Date of Patent: May 18, 2004

(54) METHOD AND APPARATUS FOR SETTING VALVE LIFT WITHIN A CYLINDER

(75) Inventor: Ronald J. Pierik, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/080,214

(22) Filed: Feb. 21, 2002

(65) Prior Publication Data

US 2003/0154940 A1 Aug. 21, 2003

(51) Int. Cl.[7] ..... F01L 1/34

(52) U.S. Cl. ..... 123/90.16; 123/90.15; 74/568 R

(58) Field of Search ..... 123/90.15, 90.16, 123/90.17; 74/567, 568 R

(56) References Cited

U.S. PATENT DOCUMENTS

| | | | | | |
|---|---|---|---|---|---|
| 5,718,152 | A | * | 2/1998 | Thudium et al. | 74/567 |
| 5,860,328 | A | * | 1/1999 | Regueiro | 74/568 R |
| 6,123,053 | A | * | 9/2000 | Hara et al. | 123/90.16 |
| 6,513,467 | B2 | * | 2/2003 | Nohara et al. | 123/90.15 |
| 6,568,361 | B2 | * | 5/2003 | Hara et al. | 123/90.29 |

* cited by examiner

*Primary Examiner*—Thomas Denion
*Assistant Examiner*—Jaime Corrigan
(74) *Attorney, Agent, or Firm*—Patrick M. Griffin

(57) ABSTRACT

A variable valve actuating (VVA) mechanism includes a frame member and a rocker. The rocker includes a first end and a second end, with the first end being pivotally coupled to the frame. A link includes a first end and a second end. A first pin pivotally couples the first end of the link to the second end of the rocker. A second pin pivotally couples an output cam to the second end of the link. At least one of the first and second pins is an eccentric pin.

21 Claims, 4 Drawing Sheets

METHOD AND APPARATUS FOR SETTING VALVE LIFT WITHIN A CYLINDER

TECHNICAL FIELD

The present invention relates to variable valve actuating mechanisms and, more particularly, to a variable valve actuating mechanism that enables adjustment of the amount by which one valve is lifted relative to another valve within the same engine cylinder.

BACKGROUND OF THE INVENTION

Modern internal combustion engines may incorporate advanced throttle control systems, such as, for example, intake valve throttle control systems, to improve fuel economy and performance. Generally, intake valve throttle control systems control the flow of gas and air into and out of the engine cylinders by varying the timing and/or lift (i.e., the valve lift profile) of the cylinder valves in response to engine operating parameters, such as engine load, speed, and driver input. For example, the valve lift profile is varied from a relatively high-lift profile under high-load engine operating conditions to a reduced/lower low-lift profile under engine operating conditions of moderate and low loads.

Intake valve throttle control systems vary the valve lift profile through the use of various mechanical and/or electromechanical configurations, collectively referred to herein as variable valve actuation mechanisms. Several examples of particular variable valve actuation mechanisms are detailed in commonly-assigned U.S. Pat. No. 5,937,809, the disclosure of which is incorporated herein by reference. A variable valve actuation mechanism varies the lift profiles of one or more associated valves from a high-lift profile under high-load engine operating conditions to a reduced/lower low-lift profile under engine operating conditions of moderate and low loads. The valves may be lifted, for example, 8–10 millimeter (mm) under the high-lift profile and 1.0 mm or less under the low-lift profile. Contemporary engines typically include 4 valves per cylinder, i.e., two intake valves and two exhaust valves. The engine may be variously configured, such as, for example, with one variable valve actuation mechanism per cylinder that actuates both intake valves of that cylinder or configured with two variable valve actuation mechanisms per cylinder each of which actuate a corresponding pair of intake or exhaust valves.

Variable valve actuating mechanisms may be manually adjusted during installation in order to match the peak lifts of valves in different cylinders. Matching the peak valve lifts of valves in different cylinders increases engine stability and reduces rough engine operation, especially at low peak lift operating conditions. Matching the peak lifts ensures each of the valves is opened the same amount and, thus, each cylinder produces approximately the same amount of power. Although the peak lifts of valves of different cylinders can be matched, conventional variable valve actuating mechanisms do not enable the adjustment and/or matching of peak valve lifts of the valves associated with an individual engine cylinder. Thus, the peak lifts of the valves associated with an individual engine cylinder may be undesirably mismatched.

An undesirable mismatch between the peak lifts of valves associated with an individual engine cylinder is generally attributable to dimensional variation, and will typically be in the range of from approximately 1.0 mm to approximately 0.5 mm or less. When the valves are actuated such that their peak lifts are relatively high, such as, for example, greater than 8 mm, such a mismatch constitutes a relatively small percentage of the peak lift. However, under certain engine operating conditions, such as, for example, engine idle and low speed engine operating conditions, the valves are actuated such that their peak lift is relatively small, such as, for example, from approximately 0.5 millimeters (mm) to approximately 1.0 mm of peak lift. At such relatively low peak lift amounts, such a mismatch constitutes a substantial and significant percentage of the peak valve lift. Thus, the mismatch in lifts becomes proportionally greater as the peak lifts decrease.

A mismatch between the peak lifts of the valves associated with an individual engine cylinder can result in undesirable or unintended airflow characteristics, such as, for example, reduced tumble and/or excessive swirl. Since the mismatch becomes proportionally greater relative to the peak valve lift as the peak valve lift decreases, these undesirable characteristics are also magnified as the peak valve lifts decrease.

Therefore, what is needed in the art is an apparatus and method that enables the peak valve lifts within a cylinder to be adjusted and, thus, set or calibrated to within a relatively close or desired tolerance.

Furthermore, what is needed in the art is an apparatus and method that enables the peak valve lifts within a cylinder to be matched to within a relatively close tolerance at low peak lift engine operating conditions.

SUMMARY OF THE INVENTION

The present invention provides a variable valve actuating mechanism that enables independent adjustment of the peak lift of one valve relative to another valve actuated by the same mechanism.

The invention comprises, in one form thereof, a frame member and a rocker. The rocker includes a first end and a second end, with the first end being pivotally coupled to the frame. A link includes a first end and a second end. A first pin pivotally couples the first end of the link to the second end of the rocker. A second pin pivotally couples an output cam to the second end of the link. At least one of the first and second pins is an eccentric pin.

An advantage of the present invention is that the peak valve lift of one valve relative to another valve within the same cylinder is adjustable.

A further advantage of the present invention is that the peak lifts of the valves within a cylinder are matched and/or set to within a relatively close tolerance.

A still further advantage of the present invention is that tumble and/or swirl within a cylinder is adjusted by adjusting the relative lifts of the valves within the cylinder.

An even further advantage of the present invention is that the peak lifts of the valves within a cylinder are matched to within a relatively close tolerance at low peak lift engine operating conditions.

BRIEF DESCRIPTION OF THE DRAWINGS

The above-mentioned and other features and advantages of this invention, and the manner of attaining them, will become apparent and be better understood by reference to the following description of one embodiment of the invention in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DESCRIPTION OF THE PREFERRED EMBODIMENTS

Figure 1:
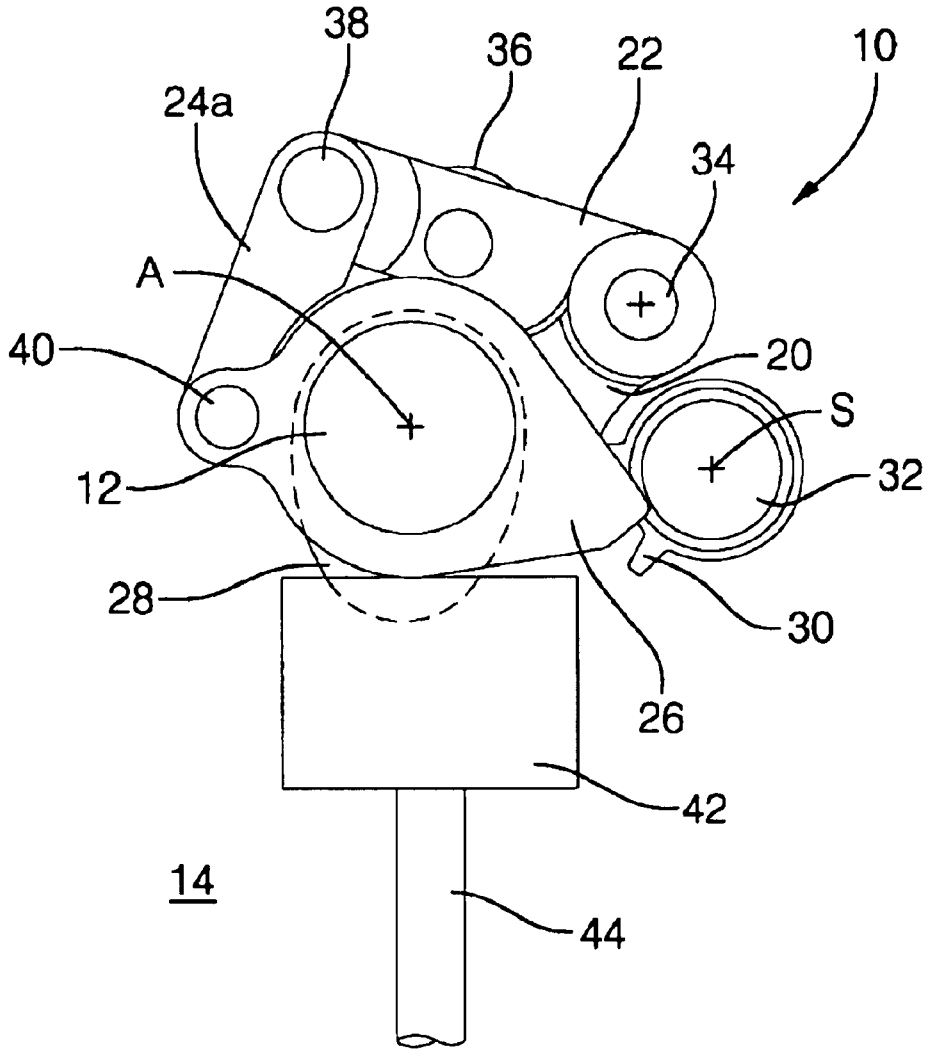
PRIOR ART FIG. 1
FIG. 1 is a side view of a conventional variable valve actuating (VVA) mechanism.

Referring now to the drawings, and particularly to FIG. 1, there is shown a conventional variable valve actuating (VVA) mechanism. VVA mechanism 10 is configured as a control gear type VVA mechanism. VVA mechanism 10 is operably installed in relation to camshaft 12 of engine 14, and includes frame 20, rocker 22, link 24*a* and output cam 26.

Camshaft 12 is driven to rotate by and in timed relation to a crankshaft (not shown) of engine 14. Camshaft 12 rotates relative to central axis A thereof, and includes cam lobe 28 that rotates as substantially one body with camshaft 12. Frame 20 is pivotally associated with camshaft 12 and is pivoted relative to central axis A by control gear 30. Control gear 30 is disposed upon and pivoted by control shaft 32, which has a central axis S that is substantially parallel relative to and spaced apart from central axis A. Frame 20 is pivotally coupled to rocker 22 by pin 34. Rocker 22 carries roller 36 that engages cam lobe 28 of camshaft 12. Rotation of cam lobe 28 pivotally oscillates roller 36 and, thus, rocker 22 in a generally radial direction toward and away from central axis A of camshaft 12. Rocker 22 is pivotally coupled to link 24*a* by pin 38, which transfers the pivotal oscillation of rocker 22 to corresponding pivotal oscillation of link 24*a*. Link 24*a* is pivotally coupled to output cam 26 by pin 40, which transfers the pivotal oscillation of link 24*a* to corresponding pivotal oscillation of output cam 26. The pivotal oscillation of output cam 26 acts on cam follower 42, such as, for example, a direct acting cam follower or roller finger follower, that reciprocates and thereby opens and closes valve 44 of engine 14.

The angular orientation of output cam 26 relative to central axis A and relative to cam follower 42 determines the portion of the lift profile of output cam 26 that engages cam follower 42 as output cam 26 is pivotally oscillated. Thus, the angular orientation of output cam 26 relative to central axis A and relative to cam follower 42 determines the lift profile of valve 44. As described above, frame 20 is pivoted relative to central axis A of camshaft 12 by control gear 30 which, in turn, is pivoted by control shaft 32. Control shaft 32 is placed in a predetermined angular position relative to central axis S thereof to thereby determine the angular position of frame 20 and, thus, output cam 26 relative to central axis A. Output cam 26 is thus placed in a predetermined angular orientation relative to central axis A which corresponds to a desired valve lift profile.

Valve 44 is one of the valves, such as, for example, an intake valve, associated with a cylinder (not shown) of engine 14. Each cylinder of engine 14 includes, for example, two intake valves and two exhaust valves. Thus, although not shown in FIG. 1, VVA mechanism 10 may include a second link and output cam assembly that actuates one of the other valves of the same cylinder with which valve 44 is associated.

As described above, conventional variable valve actuating mechanisms do not enable the peak valve lifts of the valves actuated thereby to be relatively adjusted. Thus, there is likely to be a mismatch between the peak lift amounts of the valves actuated by the variable valve actuating mechanism. A relatively small mismatch, such as, for example, 0.5 mm, between the peak lifts of the valves within an engine cylinder can result in undesirable airflow characteristics within the cylinder, such as, for example, reduced tumble and/or excessive swirl. The present invention enables the relative peak lifts of the valves to be matched and/or set, thereby enabling adjustment of tumble and/or swirl within that cylinder. Furthermore, dimensional variation within a conventional variable valve actuating mechanisms results in a mismatch between valve lifts operating under relatively low peak lift operating conditions. The present invention enables the lifts of valves operating under such low peak lift operation conditions to be more closely matched, thereby improving engine stability and reducing rough engine idling.

Figure 2:
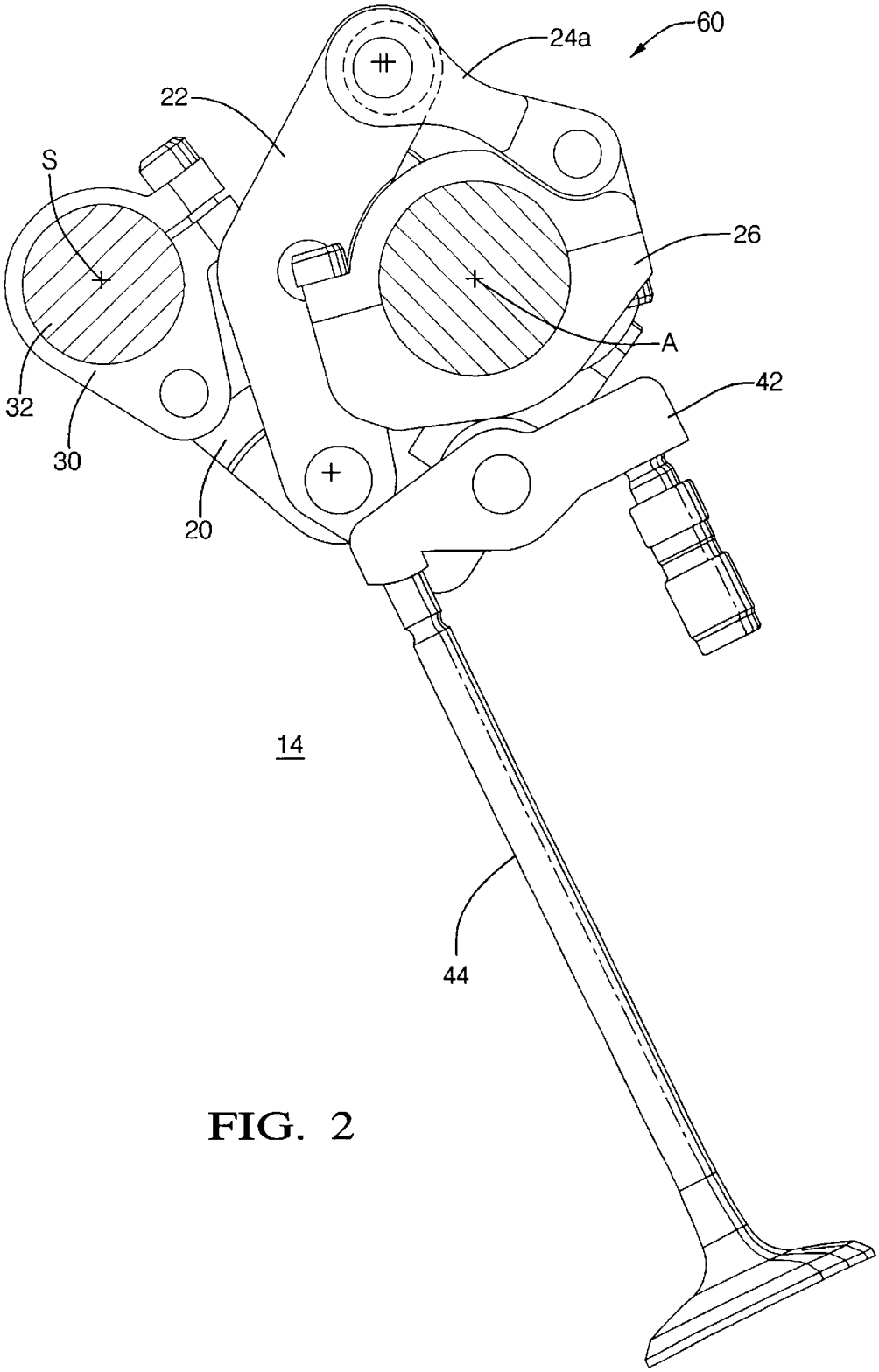
FIG. 2 is a side view of one embodiment of a variable valve actuating mechanism of the present invention.
Figures 3, 4:
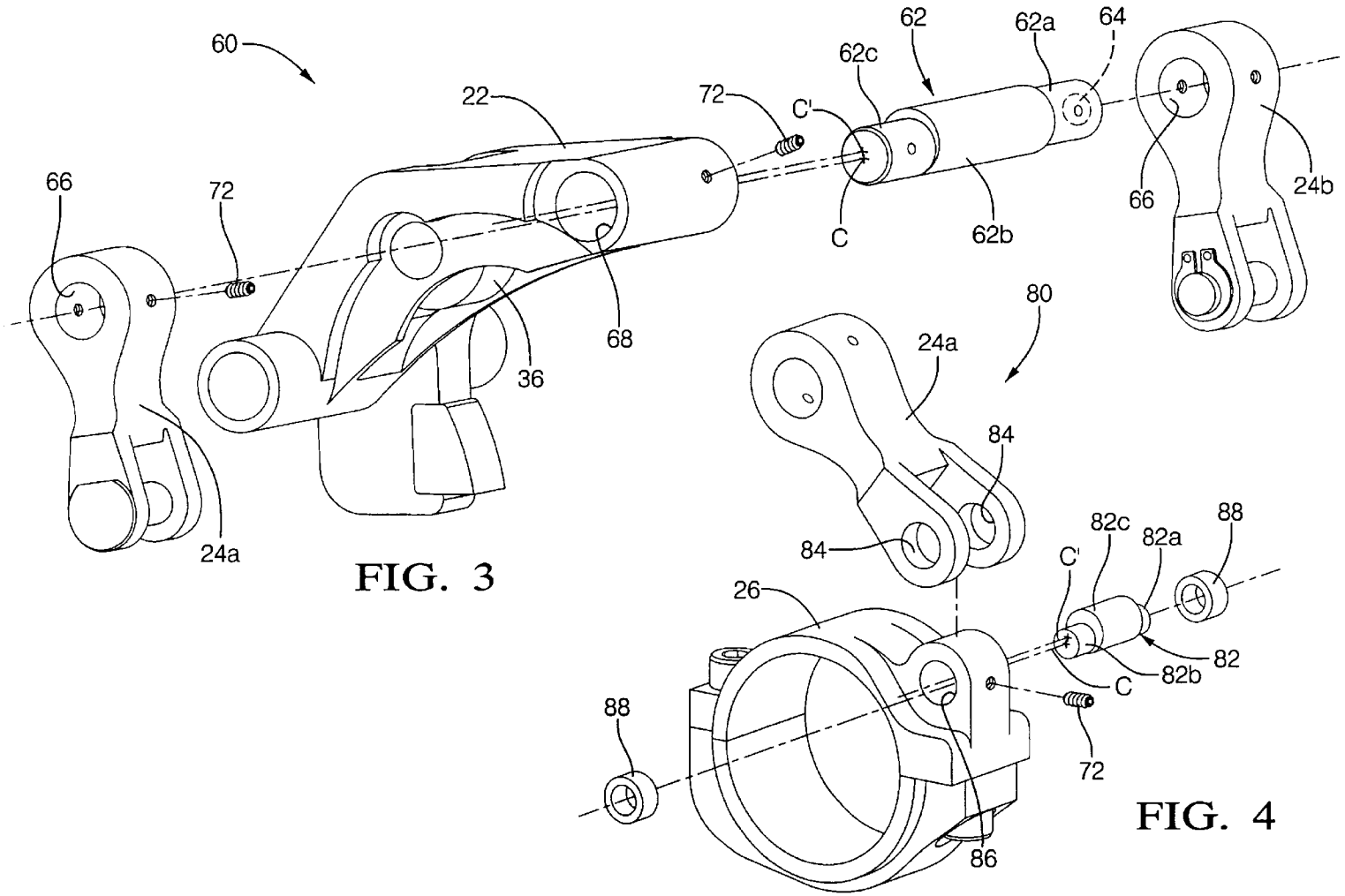
FIG. 3 is an exploded view of the rocker, links and eccentric pin of FIG. 2.
FIG. 4 is a partial, exploded view of an alternate embodiment of a VVA mechanism of the present invention.
Figure 5:
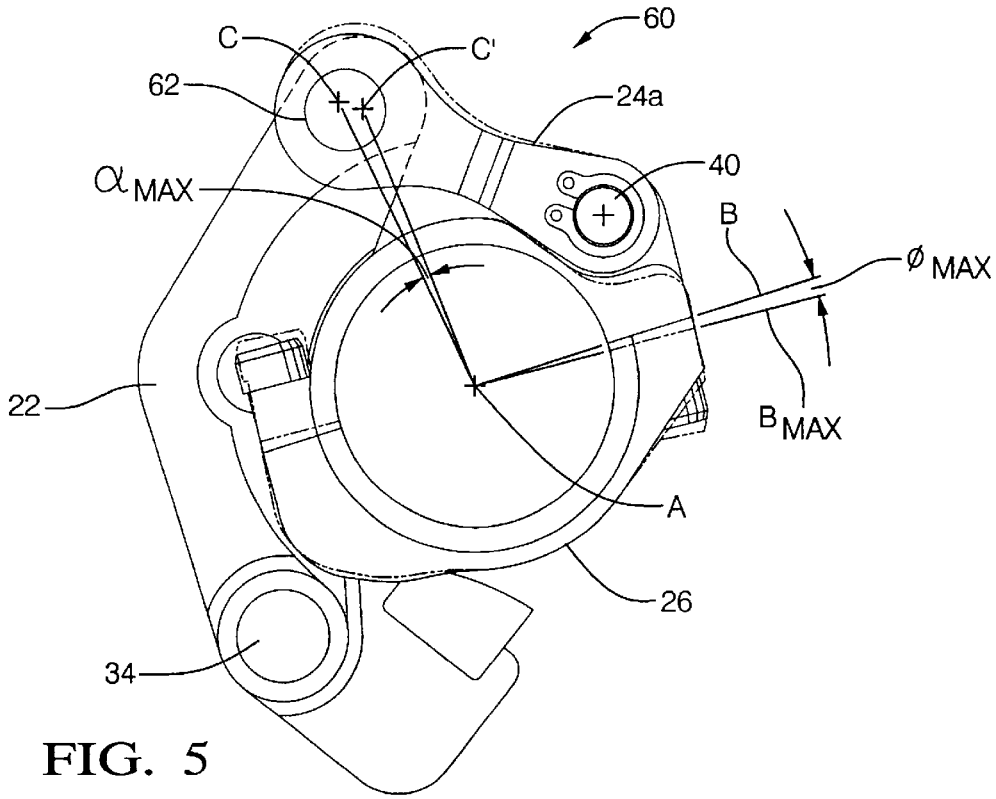
FIG. 5 is a side view of the VVA mechanism of FIG. 3.

Referring now to FIGS. 2, 3 and 5, one embodiment of a VVA mechanism of the present invention is shown. VVA mechanism 60, although differently configured from VVA mechanism 10 (FIG. 1), includes several parts that correspond to VVA mechanism 10 in function and in design, and corresponding reference numbers are used to refer to those corresponding parts. VVA mechanism 60 includes frame 20, rocker 22 carrying roller 36 (FIG. 3), links 24*a* and 24*b* (FIG. 3), output cam 26, control clamp 30 and control shaft 32 (shown in FIG. 2 only).

Generally, VVA mechanism 60 substitutes an eccentric pin for pin 38 of VVA 10 (FIG. 1) to pivotally couple rocker 22 to links 24*a*, 24*b*. The use of an eccentric pin to pivotally couple rocker 22 to links 24*a* and 24*b* enables the lift of a first valve (not shown) actuated by output cam 26 via link 24*a* to be matched and/or set relative to the lift of a second valve (not shown) actuated by a second output cam (not shown) via link 24*b* of VVA mechanism 60.

As best shown in FIGS. 3 and 5, VVA mechanism 60 includes eccentric pin 62 that pivotally couples together rocker 22 and links 24*a* and 24*b*. Eccentric pin 62 has a first centerline C and a second centerline C' that is substantially parallel relative to and spaced apart from centerline C. Eccentric pin 62 further includes pin sections 62*a*, 62*b* and eccentric pin section 62*c*.

Pin section 62*a* extends axially from one side of pin section 62*b*, and both pin section 62*a* and section 62*b* are substantially concentric relative to each other and relative to centerline C. Eccentric section 62*c* is substantially concentric relative to centerline C' and is, thus, eccentric relative to centerline C and pin sections 62*a* and 62*b*. The amount or distance by which centerlines C and C' are separated, i.e., the degree of relative eccentricity of centerlines C and C', is from approximately 0.001 millimeters (mm) to approximately 1.0 mm. At least one of pin section 62*a* and eccentric section 62*c* define tool-accepting feature 64 (FIG. 3, shown in pin section 62*a*), such as, for example, a hexagonal socket. Tool-accepting feature 64 accepts a tool, such as, for example, an Allen wrench or other type of wrench, to facilitate rotation and/or adjustment of the angular orientation of eccentric pin 62 when in the installed or use position.

As stated above, eccentric pin 62 pivotally couples together rocker 22 and links 24*a*, 24*b*. More particularly, pin section 62*a* is received within orifice 66 formed in link 24*b*, eccentric section 62*c* is received within orifice 66 formed in link 24*a*, and pin section 62*b* is received within bore 68 formed through rocker 22. One of retaining means 72 (two shown), such as, for example, set screws, retains eccentric pin 62 in position within bore 69 and orifice 66, and retains centerline C' in a desired angular position or relative orientation relative to centerline C. It is to be understood that two retaining means 72 are shown only to illustrate two possible locations therefor. The use of both retaining means 72 is not required and, furthermore, would cause slippage between and undesirable wear of retaining means 72 and/or eccentric pin 62.

Link 24*a* is pivotally coupled by pin 40 (FIG. 5) to output cam 26, whereas link 24*b* is pivotally coupled to the second output cam (not shown) of VVA mechanism 60 by a second pin (not shown).

In use, the nominal lift and/or the nominal lift profile of the valves associated with VVA mechanism 60 is set by the angular position of control shaft 32 (FIG. 2) relative to central axis S thereof, as is known in the art. Generally, VVA mechanism 60 enables the peak lift of the valve actuated by output cam 26 to be matched with and/or set relative to the peak lift of the valve (not shown) actuated by the second output cam (not shown) of VVA mechanism 60 by pivoting eccentric pin 62 relative to centerline C. More particularly, pivoting eccentric pin 62 relative to centerline C pushes and/or pulls on link 24*a* to thereby pivot output cam 26 relative to central axis A. Pivoting output cam 26 relative to central axis A, in turn, changes the portion of the lift profile of output cam 26 that engages cam follower 42 (FIGS. 1 and 2) associated therewith and which transfers pivotal oscillation of output cam 26 to actuation of the associated valve (not shown). The portion of the lift profile of output cam 26 that engages the cam follower determines the amount of lift imparted to the associated valve. Thus, by pivoting eccentric pin 62 the peak lift of the valve associated with output cam 26 is adjusted relative to the peak lift of a second valve that is actuated by a second output cam of VVA mechanism 60.

The effect of pivoting eccentric pin 62 on the angular orientation of output cam 26 is hereinafter discussed in detail. Referring to FIG. 5, angle $\alpha$ is defined between respective lines drawn from centerlines C and C' to central axis A of camshaft 12. With angle $\alpha$ equal to zero degrees, output cam 26 occupies a base angular orientation B relative to central axis A of camshaft 12. Output cam 26 in base angular orientation B imparts substantially the desired nominal lift to the associated valve, since the position of output cam 26 is substantially unchanged from that established by control shaft 32. Angle $\phi$ is defined as the degree to which output cam 26 has been pivoted from the base angular orientation B thereof relative to central axis A and into a new or adjusted base angular orientation. Generally, pivoting eccentric pin 62 relative to the centerline C varies angle $\alpha$. A change in angle $\alpha$ results in a corresponding change in angle $\phi$ and, thus, a change in the angular orientation of output cam 26 relative to central axis A.

More particularly, as eccentric pin 62 is pivoted centerline C' and eccentric section 62*c* (FIG. 3) pivot relative to centerline C thus causing angle $\alpha$ to vary. The pivoting of eccentric section 62*c* pushes and/or pulls link 24*a* thereby pivoting output cam 26 relative to central axis A and varying angle $\phi$. Angle $\alpha$ is varied by rotation of eccentric pin 62 from a positive or clockwise maximum value $\alpha_{MAX}$ to a negative or counter-clockwise maximum value referred to hereinafter as $\alpha_{MIN}$ (not shown). Similarly, angle $\phi$ is varied by the rotation of eccentric pin 62 from a positive or clockwise maximum $\phi_{MAX}$ to a negative or counterclockwise maximum hereinafter referred to as $\phi_{MIN}$ (not shown).

Each of angles $\alpha$ and $\phi$ are approximately equal to zero degrees with eccentric pin 62 oriented such that centerlines C and C' are approximately coplanar with central axis A, regardless of whether centerline C or centerline C' is disposed most proximate to central axis A. Thus, angles $\alpha$ and $\phi$ are approximately equal to zero degrees with eccentric pin 62 in one of the two aforementioned angular orientations. With angles $\alpha$ and $\phi$ equal to zero degrees, output cam 26 is oriented in base angular orientation B. Thus, the lift imparted by output cam 26 to the associated valve is approximately the nominal lift as established by control shaft 32.

Angle $\alpha$ is maximized in the clockwise direction to $\alpha_{MAX}$ by pivoting eccentric pin 62 such that centerlines C and C' are disposed in a generally coplanar manner with the central axis (not referenced) of pin 40 with centerline C' being disposed most proximate to pin 40. Pivoting eccentric pin 62 to place angle $\alpha$ at $\alpha_{MAX}$ displaces or pushes link 24*a* in a clockwise direction, and thereby causes output cam 26 to pivot relative to central axis A in a clockwise direction such that angle $\phi$ is also maximized in a clockwise direction to angle $\phi_{MAX}$. Thus, output cam 26 is oriented in a new or adjusted base angular orientation $B_{MAX}$ by pivoting eccentric pin 62 such that centerlines C and C' are disposed in a generally coplanar manner relative to the central axis (not referenced) of pin 40 with centerline C' being disposed most proximate to pin 40.

Adjusted base angular orientation $B_{MAX}$ represents the maximum clockwise angular orientation of output cam 26, i.e., output cam 26 is maximally pivoted in a clockwise direction relative to base angular orientation B. Orienting output cam 26 in adjusted base orientation $B_{MAX}$ disposes a greater portion of the low lift or constant radius portion of output cam 26 within the pivotal oscillatory range of output cam 26. As output cam 26 is pivotally oscillated from adjusted base orientation $B_{MAX}$, more of the low-lift portion of the lift profile of output cam 26 engages the cam follower relative to the portion that engages the cam follower when output cam 26 is pivotally oscillated from base orientation B. Thus, the lift imparted to the associated valve when output cam 26 is pivotally oscillated from adjusted base orientation $B_{MAX}$ is maximally reduced relative to the nominal lift that is imparted by pivotally oscillating output cam 26 from base orientation B.

Angle $\alpha$ is maximized in the counterclockwise direction to $\alpha_{MIN}$ (not shown) by pivoting eccentric pin 62 such that centerlines C and C' are disposed approximately coplanar with the central axis (not referenced) of pin 40 with centerline C being disposed most proximate to pin 40. Pivoting eccentric pin 62 to place angle $\alpha$ at $\alpha_{MIN}$ displaces or pulls link 24*a* in a counter-clockwise direction and thereby causes output cam 26 to pivot relative to central axis A in a counter-clockwise direction such that angle $\phi$ is also maximized in a counter-clockwise direction to angle $\phi_{MIN}$ (not shown). Thus, output cam 26 is oriented in a new or adjusted base angular orientation $B_{MIN}$ (not shown) by pivoting eccentric pin 62 such that centerlines C and C' are disposed approximately coplanar relative to the central axis (not referenced) of pin 40 with centerline C being disposed most proximate to pin 40.

Adjusted base orientation $B_{MIN}$ represents the maximum counter-clockwise base position of output cam 26, i.e., output cam 26 is maximally pivoted in a counterclockwise direction relative to base angular orientation B. Orienting output cam 26 in adjusted base orientation $B_{MIN}$ disposes a greater portion of the higher lift profile of output cam 26 within the pivotal oscillation range of output cam 26. As output cam 26 is pivotally oscillated from adjusted base orientation $B_{MIN}$, more of the high lift portion of the lift profile of output cam 26 engages the cam follower relative to the portion that engages the cam follower when output cam 26 is pivotally oscillated from adjusted base orientation $B_{MIN}$. Thus, the lift imparted to the associated valve when output cam 26 is pivotally oscillated from adjusted base position $B_{MIN}$ is maximally increased relative to the nominal lift that is imparted by pivotally oscillating output cam 26 from base angular orientation B.

It should be particularly noted that the angular orientation of eccentric pin 62 and, thus, the angular position of centerline C' relative to centerline C are variable through three hundred and sixty degrees. Therefore, VVA 60 enables the substantially continuous adjustment of the lift of the valve associated with output cam 26. The lift of the associated valve is minimized, i.e., adjusted to a peak value of the nominal lift minus an adjustment value, with output cam 26 oriented in adjusted base position $B_{MAX}$. Conversely, the lift of the associated valve is maximized, i.e., adjusted to a peak value of the nominal lift plus an adjustment value, with output cam 26 oriented in adjusted base position $B_{MIN}$.

Pivoting eccentric pin 62 in either a clockwise or counterclockwise direction with output cam 26 in adjusted base angular orientation $B_{MAX}$, wherein the lift is minimized, increases the lift imparted to the associated valve. More particularly, such a pivoting of eccentric pin 62 displaces or pulls link 24*a* thereby causing output cam 26 to pivot in a counterclockwise direction. As output cam 26 pivots in a counterclockwise direction from adjusted base angular orientation $B_{MAX}$, the high lift portion thereof is brought angularly more proximate to the cam follower. Thus, as output cam 26 is pivotally oscillated more of the high lift portion of the lift profile of output cam 26 engages the cam follower relative to adjusted base angular orientation $B_{MAX}$.

The counterclockwise pivoting of output cam 26, and thus the increase in lift imparted to the associated valve, continues until eccentric pin 62 is pivoted in either direction approximately one-hundred eighty degrees (180°) from adjusted base angular orientation $B_{MAX}$. Pivoting eccentric pin 62 approximately 180° in either direction from adjusted base angular orientation $B_{MAX}$ orients eccentric pin 62 such that centerlines C and C' are substantially coplanar relative to the central axis of pin 40 with centerline C most proximate to pin 40. Thus, output cam 26 is placed in adjusted base angular orientation $B_{MIN}$ wherein the lift imparted to the valve is maximized.

Conversely, pivoting eccentric pin 62 in either a clockwise or counterclockwise direction with output cam 26 in adjusted base angular orientation $B_{MIN}$, wherein the lift is maximized, decreases the lift imparted to the associated valve. Such a pivoting of eccentric pin 62 displaces or pushes link 24*a* in a clockwise direction thereby causing output cam 26 to pivot in a clockwise direction. As output cam 26 pivots in a clockwise direction from adjusted base angular orientation $B_{MIN}$, the low lift portion thereof is brought angularly more proximate to the cam follower. Thus, as output cam 26 is pivotally oscillated more of the low lift portion of the lift profile of output cam 26 engages the cam follower relative to adjusted base angular orientation $B_{MAX}$. The clockwise pivoting of output cam 26, and thus the decrease in lift imparted to the associated valve, continues until eccentric pin 62 is pivoted in either direction approximately 180° from adjusted base angular orientation $B_{MIN}$.

As stated above, the relative eccentricity of centerlines C and C' is from approximately 0.001 mm to approximately 1.0 mm. Centerlines C and C' can be positioned such that they are each substantially coplanar relative to the central axis of pin 40 in two possible orientations, i.e., one with centerline C' most proximate to pin 40 and the other with centerline C most proximate to pin 40. Thus, for example, with a given eccentricity of 1.0 mm the eccentricity of eccentric pin 62 is continuously adjustable from ±1.0 mm relative to (i.e., toward and away from) pin 40. The corresponding range over which output cam 26 is pivoted relative to central axis A, and thus the range over which the lift of the valve associated with output cam 26 is adjusted, is dependent upon the configuration of the particular VVA mechanism with which eccentric pin 62 is used.

Adjustment of the angular orientation of eccentric pin 62 is facilitated by, for example, inserting a wrench or other tool into, tool-accepting feature 64. With eccentric pin 62 in the desired angular orientation, either one of retaining means 72 is installed and tightened to secure and retain eccentric pin 62 in the desired orientation and position within orifices 66 and bore 68. Thus, the lift of the valve associated with output cam 26 is adjusted from a nominal value to an adjusted valve relative to the lift of the second valve actuated by the second output cam of VVA mechanism 60. The relative lifts of the valve actuated by output cam 26 and the second output cam are set and/or calibrated to achieve, for example, matching peak lifts or a desirable difference in peak lifts to create favorable air flow characteristics within the cylinder.

Figure 6:
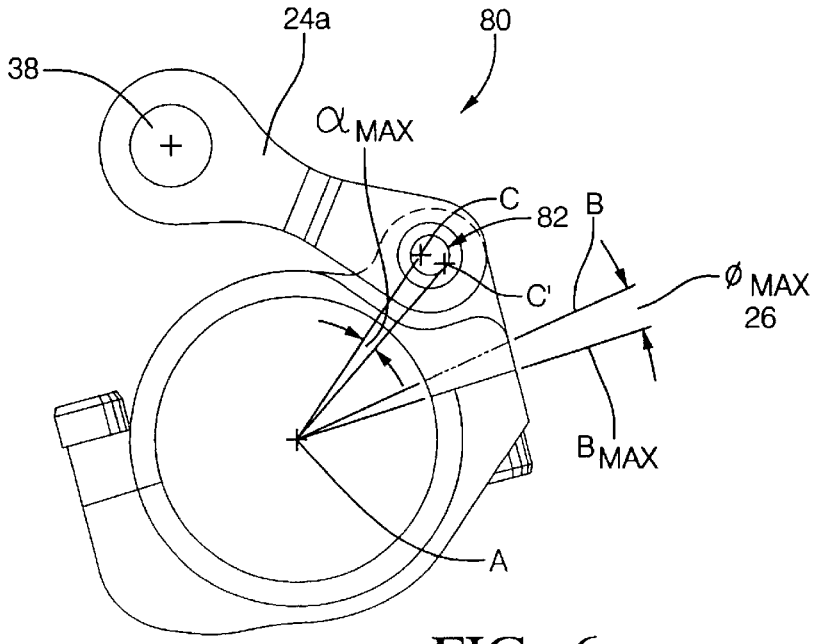
FIG. 6 is a side view of the VVA mechanism of FIG. 4.

Referring now to FIGS. 4 and 6, a second exemplary embodiment of a VVA mechanism of the present invention is shown. Generally, VVA mechanism 80 substitutes an eccentric pin for pin 40 of VVA 10 (FIG. 1) to pivotally couple links 24*a* and 24*b* to output cam 26. The eccentric pin enables the lift of a first valve (not shown) actuated by output cam 26 via link 24*a* to be matched with and/or set relative to the lift of a second valve (not shown) actuated by a second output cam via link 24*b* (not shown) of VVA mechanism 80.

VVA mechanism 80 includes eccentric pin 82 having centerlines C and C', pin sections 82*a*, 82*b*, and eccentric section 82*c*. Centerline C is substantially parallel relative to and spaced apart from centerline C'. Pin section 82*a* extends axially from one side of eccentric section 82*c*, and pin section 82*b* extends axially from an opposite end of eccentric section 82*c*. Pin sections 82*a* and 82*b* are substantially concentric relative to each other and relative to centerline C. Eccentric section 82*c* is substantially concentric relative to centerline C' and is, thus, eccentric relative to centerline C and pin sections 82*a* and 82*b*. The amount or distance by which centerlines C and C' are separated, i.e., the degree of relative eccentricity of centerlines C and C', is from approximately 0.001 millimeters (mm) to approximately 1.0 mm.

Eccentric pin 82 pivotally couples link 24*a* with output cam 26. Pin sections 82*a* and 82*b* are received within a respective one of orifices 84 formed in link 24*a*, and eccentric section 82*c* is received within orifice 86 formed in output cam 26. Retaining means 72, such as, for example, a set screw, retains eccentric pin 62 within orifice 86 and further retains centerline C' and centerline C in a desired angular position and/or relative angular orientation. Collars or bushings 88 are inserted into a respective one of orifices 84 and over a corresponding one of pin sections 82*a* and 82*b*.

In use, VVA mechanism 80 operates in a generally similar manner to VVA mechanism 60 and enables the lift of the valve associated with output cam 26 to be matched with and/or set relative to the lift of a second valve actuated by a second output cam of VVA mechanism 80. The nominal lift and/or the nominal lift profile of the valves associated with VVA mechanism 60 is set by the angular position of control shaft 32 (FIG. 2) relative to central axis S thereof, as is known in the art.

The effect of pivoting eccentric pin 82 on the angular orientation of output cam 26 is hereinafter discussed in detail. Referring to FIG. 6, angle $\alpha$ is varied by rotation of eccentric pin 82 from a positive or clockwise maximum value $\alpha_{MAX}$ to a negative or counter-clockwise maximum value $\alpha_{MIN}$ (not shown). Similarly, angle $\phi$ is varied by the rotation of eccentric pin 82 from a positive or clockwise maximum $\phi_{MAX}$ to a negative or counterclockwise maximum $\phi_{MIN}$ (not shown).

Each of angles $\alpha$ and $\phi$ are approximately equal to zero degrees with eccentric pin 82 oriented such that centerlines C and C' are approximately coplanar with central axis A, regardless of whether centerline C or centerline C' is disposed most proximate to central axis A. Thus, angles $\alpha$ and $\phi$ are approximately equal to zero degrees with eccentric pin 82 in one of the two aforementioned angular orientations. With angles $\alpha$ and $\phi$ equal to zero degrees, output cam 26 is oriented in base angular orientation B. Thus, the lift imparted by output cam 26 to the associated valve is approximately the nominal lift as established by control shaft 32.

Angle $\alpha$ is maximized in the clockwise direction to $\alpha_{MAX}$ by pivoting eccentric pin 82 such that centerlines C and C' are disposed in a generally coplanar manner with the central axis (not referenced) of pin 38 with centerline C being disposed most proximate to pin 38. Pivoting eccentric pin 82 to place angle $\alpha$ at $\alpha_{MAX}$ displaces or pushes output cam 26 in a clockwise direction, and thereby causes output cam 26 to pivot relative to central axis A in a clockwise direction such that angle $\phi$ is also maximized in a clockwise direction to angle $\phi_{MAX}$. Thus, output cam 26 is oriented in adjusted base angular orientation $B_{MAX}$ with eccentric pin 82 oriented such that centerlines C and C' are disposed in a generally coplanar manner relative to the central axis (not referenced) of pin 30 with centerline C being disposed most proximate to pin 38.

Adjusted base position $B_{MAX}$ represents the maximum clockwise base position of output cam 26, i.e., output cam 26 is maximally pivoted in a clockwise direction relative to base angular orientation B. Orienting output cam 26 in adjusted base orientation $B_{MAX}$ disposes a greater portion of the low lift or constant radius portion of output cam 26 within the pivotal oscillatory range of output cam 26. As output cam 26 is pivotally oscillated from adjusted base orientation $B_{MAX}$, more of the low-lift portion of the lift profile of output cam 26 engages the cam follower relative to the portion that engages the cam follower when output cam 26 is pivotally oscillated from base position B. Thus, the lift imparted to the associated valve when output cam 26 is pivotally oscillated from adjusted base orientation $B_{MAX}$ is maximally reduced relative to the nominal lift that is imparted by pivotally oscillating output cam 26 from base position B.

Angle $\alpha$ is maximized in the counterclockwise direction to $\alpha_{MIN}$ (not shown) by pivoting eccentric pin 82 such that centerlines C and C' are disposed approximately coplanar with the central axis (not referenced) of pin 38 with centerline C' being disposed most proximate to pin 30. Pivoting eccentric pin 82 to place angle $\alpha$ at $\alpha_{MIN}$ displaces or pulls output cam 26 in a counter-clockwise direction such that angle $\phi$ is also maximized in a counter-clockwise direction to angle $\phi_{MIN}$ (not shown). Thus, output cam 26 is oriented in adjusted base angular orientation $B_{MIN}$ (not shown).

Adjusted base orientation $B_{MIN}$ represents the maximum counter-clockwise base position of output cam 26, i.e., output cam 26 is maximally pivoted in a counterclockwise direction relative to base angular orientation B. Orienting output cam 26 in adjusted base orientation $B_{MIN}$ disposes a greater portion of the higher lift profile of output cam 26 within the pivotal oscillation range of output cam 26. As output cam 26 is pivotally oscillated from adjusted base orientation $B_{MIN}$, more of the high lift portion of the lift profile of output cam 26 engages the cam follower relative to the portion that engages the cam follower when output cam 26 is pivotally oscillated from adjusted base orientation $B_{MIN}$. Thus, the lift imparted to the associated valve when output cam 26 is pivotally oscillated from adjusted base position $B_{MIN}$ is maximally increased relative to the nominal lift that is imparted by pivotally oscillating output cam 26 from base angular orientation B.

It should be particularly noted that, substantially similar to VVA mechanism 60, the angular orientation of eccentric pin 82 of VVA mechanism 80 and, thus, the angular orientation of centerline C' relative to centerline C are variable through three hundred and sixty degrees. Accordingly, the angular orientation of output cam 26 is substantially continuously adjustable from adjusted base orientation $B_{MIN}$ to adjusted base orientation $B_{MAX}$. Therefore, the lift of the valve associated with output cam 26 is also substantially continuously adjustable from a maximally increased lift to a maximally decreased lift relative to the nominal lift, as determined by the angular orientation of control shaft 32. The lift of the valve associated with output cam 26 is thereby set or relative to or calibrated with the lift of the valve associated with the second output cam of VVA mechanism 80.

It should further be particularly noted that, substantially similar to VVA mechanism 60, pivoting eccentric pin 82 in either a clockwise or counterclockwise direction with output cam 26 in adjusted base angular orientation $B_{MAX}$, wherein the lift is minimized, increases the lift imparted to the associated valve. Conversely, and still substantially similar to VVA mechanism 60, pivoting eccentric pin 82 in either a clockwise or counterclockwise direction with output cam 26 in adjusted base angular orientation $B_{MIN}$, wherein the lift is maximized, decreases the lift imparted to the associated valve.

In the embodiments shown, an eccentric pin couples together at least one of the links with one of a rocker or corresponding output cam. However, it is to be understood that the VVA of the present invention can be alternately configured, such as, for example, with an eccentric pin coupling at least one of the links with each of a corresponding output cam and the rocker.

In the embodiments shown, the eccentric pins are shown in conjunction with a particularly configured VVA mechanism. However, it is to be understood that the VVA mechanism of the present invention can be alternately configured, such as, for example, as a belt-driven VVA mechanism or any other suitable type of VVA mechanism, and still effectively adjust the amount of lift imparted to the associated valve.

In the embodiments shown, an eccentric pin is used to pivotally couple together one of two links with an output cam or one of two links with a rocker. However, it is to be understood that the present invention can be alternately configured, such as, for example, with a dual or integrated link (rather than two separate links) that is pivotally coupled by an eccentric pin to one of a pair of output cams or to a corresponding separate or an integrated rocker.

In the embodiments shown, retaining means, such as a set screw and/or a set screw and collar assembly, are used to retain the eccentric pin in the desired location and angular orientation. However, it is to be understood that the present invention can be alternately configured with various other retaining means.

In the embodiment shown, an eccentric pin is used to pivotally couple together one of a link and an output cam or a link and a rocker. However, it is to be understood that the present invention can be alternately configured, such as, for example, using an eccentric pin to pivotally couple together each link and rocker, and each link and corresponding output cam.

While this invention has been described as having a preferred design, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

What is claimed is:

1. A method for setting the lift of a first valve relative to a second valve of an engine cylinder, at least said first valve being actuated by a variable valve actuating (VVA) mechanism, said method comprising:

ascertaining the maximum lift of the second valve;

determining the maximum lift of the first valve; and pivoting an eccentric pin of the VVA mechanism to thereby pivot an output cam thereof from a base angular orientation to an adjusted base angular orientation, thereby one of increasing and decreasing the lift imparted to the first valve by the VVA mechanism, wherein said pivoting step comprises pivoting an eccentric pin that pivotally couples together a rocker and a link of the VVA mechanism.

2. A method for setting the lift of a first valve relative to a second valve of an engine cylinder, at least said first valve being actuated by a variable valve actuating (VVA) mechanism, said method comprising:

ascertaining the maximum lift of the second valve;

determining the maximum lift of the first valve; and pivoting an eccentric pin of the VVA mechanism to thereby pivot an output cam thereof from a base angular orientation to an adjusted base angular orientation, thereby one of increasing and decreasing the lift imparted to the first valve by the VVA mechanism, wherein said pivoting step comprises pivoting an eccentric pin that pivotally couples together a link and an output cam of the VVA mechanism.

3. The method of claim 2, wherein said pivoting step comprises engaging a tool-accepting feature of the eccentric pin with a corresponding tool.

4. The method of claim 3, wherein said tool-accepting feature comprises a socket defined by an end of the eccentric pin.

5. A variable valve actuating (VVA) mechanism, comprising:

a frame member configured for being pivoted relative to a central axis that is at least one of substantially parallel relative to and coaxial with a central axis of an input shaft;

a rocker having a first end and a second end, said first end pivotally coupled to said frame;

a link having a first end and a second end;

a first pin pivotally coupling said first end of said link to said second end of said rocker;

an output cam;

a second pin pivotally coupling said output cam to said second end of said link;

wherein at least one of said first and second pins is an eccentric pin.

6. The VVA mechanism of claim 5, wherein said first pin comprises an eccentric pin.

7. The VVA mechanism of claim 6, wherein said first pin comprises:

a first pin portion having a first centerline, said first pin portion being substantially concentric relative to said first centerline;

a second pin portion extending axially from said first pin portion, said second pin portion being substantially concentric relative to said first centerline; and an eccentric portion extending axially from said second pin portion, said eccentric portion having a second centerline, said eccentric portion being substantially concentric relative to said second centerline and eccentric relative to said first centerline, said second centerline being substantially parallel with and spaced apart from said first centerline.

8. The VVA mechanism of claim 7, wherein said second end of said rocker defines a rocker bore therethrough, said first end of said link defines a link bore therethrough, said eccentric portion being disposed at least partially within said link bore, said second pin portion being disposed at least partially within said rocker bore.

9. The VVA mechanism of claim 8, wherein said first centerline and said second centerline are spaced apart from each other from approximately 0.001 mm to approximately 1.5 mm.

10. The VVA mechanism of claim 5, wherein said second pin comprises an eccentric pin.

11. The VVA mechanism of claim 10, wherein said second pin comprises:

an eccentric portion having a first centerline, said eccentric portion being substantially concentric relative to said first centerline; and pin portions extending axially in each direction from said eccentric portion, said pin portions having a second centerline and being substantially concentric relative thereto, said eccentric portion being eccentric relative to said second centerline, said second centerline being substantially parallel relative to and spaced apart from said first centerline.

12. The VVA mechanism of claim 11, wherein said second end of said link defines opposing link orifices therethrough, said output cam defines a cam orifice therein, said eccentric portion being disposed within said cam orifice, said pin portions being disposed at least partially within a respective one of said link orifices.

13. The VVA mechanism of claim 11, wherein said first centerline and said second centerline are spaced apart from each other from approximately 0.015 mm to approximately 1.5 mm.

14. The VVA mechanism of claim 5, further comprising retaining means associated with each said at least one eccentric pin.

15. The VVA mechanism of claim 14, wherein said retaining means comprises a set screw.

16. The VVA mechanism of claim 5, wherein said at least one eccentric pin includes a tool-accepting feature.

17. The VVA mechanism of claim 16, wherein said tool-accepting feature comprises a recessed socket defined by an end of said eccentric pin.

18. An internal combustion engine, said engine having at least one cylinder, at least four valves operably associated with said cylinder, said engine comprising:

a variable valve actuating mechanism actuating at least one of said valves, said variable valve mechanism including:

a frame member configured for being pivoted relative to a central axis that is one of substantially parallel relative to and coaxial with a central axis of a camshaft of said engine;

a rocker having a first end and a second end, said first end pivotally coupled to said frame;

a link having a first end and a second end;

a first pin pivotally coupling said first end of said link to said second end of said rocker;

an output cam;

a second pin pivotally coupling said output cam to said second end of said link;

wherein at least one of said first and second pins is an eccentric pin.

19. A variable valve actuating (VVA) mechanism, comprising:

a frame member configured for being pivoted relative to a central axis that is at least one of substantially parallel relative to and coaxial with a central axis of an input shaft;

a rocker having a first end and a second end, said first end pivotally coupled to said frame;

a link having a first end and a second end;

a first pin pivotally coupling said first end of said link to said second end of said rocker;

an output cam;

a second pin pivotally coupling said output cam to said second end of said link;

wherein said first pin is an eccentric pin, and wherein said first pin comprises:

a first pin portion having a first centerline, said first pin portion being substantially concentric relative to said first centerline;

a second pin portion extending axially from said first pin portion, said second pin portion being substantially concentric relative to said first centerline; and an eccentric portion extending axially from said second pin portion, said eccentric portion having a second centerline, said eccentric portion being substantially concentric relative to said second centerline and eccentric relative to said first centerline, said second centerline being substantially parallel with and spaced apart from said first centerline.

20. The VVA mechanism of claim 19, wherein said second end of said rocker defines a rocker bore therethrough, said first end of said link defines a link bore therethrough, said eccentric portion being disposed at least partially within said link bore, said second pin portion being disposed at least partially within said rocker bore.

21. The VVA mechanism of claim 20, wherein said first centerline and said second centerline are spaced apart from each other from approximately 0.001 mm to approximately 1.5 mm.

* * * * *